United States Patent [19]

Asmussen et al.

[11] Patent Number: 5,008,506

[45] Date of Patent: Apr. 16, 1991

[54] RADIOFREQUENCY WAVE TREATMENT OF A MATERIAL USING A SELECTED SEQUENCE OF MODES

[75] Inventors: Jes Asmussen, Okemos; Ronald E. Fritz, Haslett, both of Mich.

[73] Assignee: Board of Trustees operating Michigan State University, East Lansing, Mich.

[21] Appl. No.: 429,063

[22] Filed: Oct. 30, 1989

[51] Int. Cl.[5] ..... H05B 6/74

[52] U.S. Cl. ..... 219/10.55 M; 219/10.55 A; 219/10.55 F; 219/10.55 B

[58] Field of Search ..... 219/10.55 A, 10.55 R, 219/10.55 F, 10.55 E, 10.55 M, 10.55 B; 34/1

[56] References Cited

U.S. PATENT DOCUMENTS

| | | | |
|---|---|---|---|
| 2,790,054 | 4/1957 | Haagensen | 219/10.55 F |
| 3,364,331 | 1/1968 | Johnson | 219/10.55 F |
| 3,699,899 | 10/1972 | Schiffmann et al. | 219/10.55 A |
| 3,851,131 | 11/1974 | Johnston et al. | 219/10.55 A |
| 4,196,332 | 4/1980 | MacKay et al. | 219/10.55 B |
| 4,314,128 | 2/1982 | Chitre | 219/10.55 B |
| 4,507,588 | 3/1985 | Asmussen et al. | 219/121 PL |
| 4,585,688 | 4/1986 | Asmussen et al. | 427/45.1 |
| 4,714,812 | 12/1987 | Haagensen et al. | 219/10.55 A |
| 4,777,336 | 10/1988 | Asmussen | 219/10.55 M |

OTHER PUBLICATIONS

J. Asmussen and J. Root, Appl. Phys. Letters 44, 396 (1984).

J. Root and J. Asmussen, Rev. of Sci. Instrum. 56, 1511 (1985).

M. Dahimene and J. Asmussen, J. Vac. Sci. Technol. B4, 126 (1986).

*Primary Examiner*—Philip H. Leung

*Attorney, Agent, or Firm*—Ian C. McLeod

[57] ABSTRACT

A radiofrequency wave apparatus including an applicator (112, 120) which provides multiple, sequenced processing modes for use in a method for heating a material is described. The modes in the applicator are selected to suit each stage of the processing of a material (B). The apparatus can include multiple circuits (11, 12 and 13) which couple the radiofrequency waves to the applicator using probes (**111*a*, 121*a* and 122*a***) in the method. The result is the optimum processing of the material.

28 Claims, 6 Drawing Sheets

RADIOFREQUENCY WAVE TREATMENT OF A MATERIAL USING A SELECTED SEQUENCE OF MODES

Figure 1:
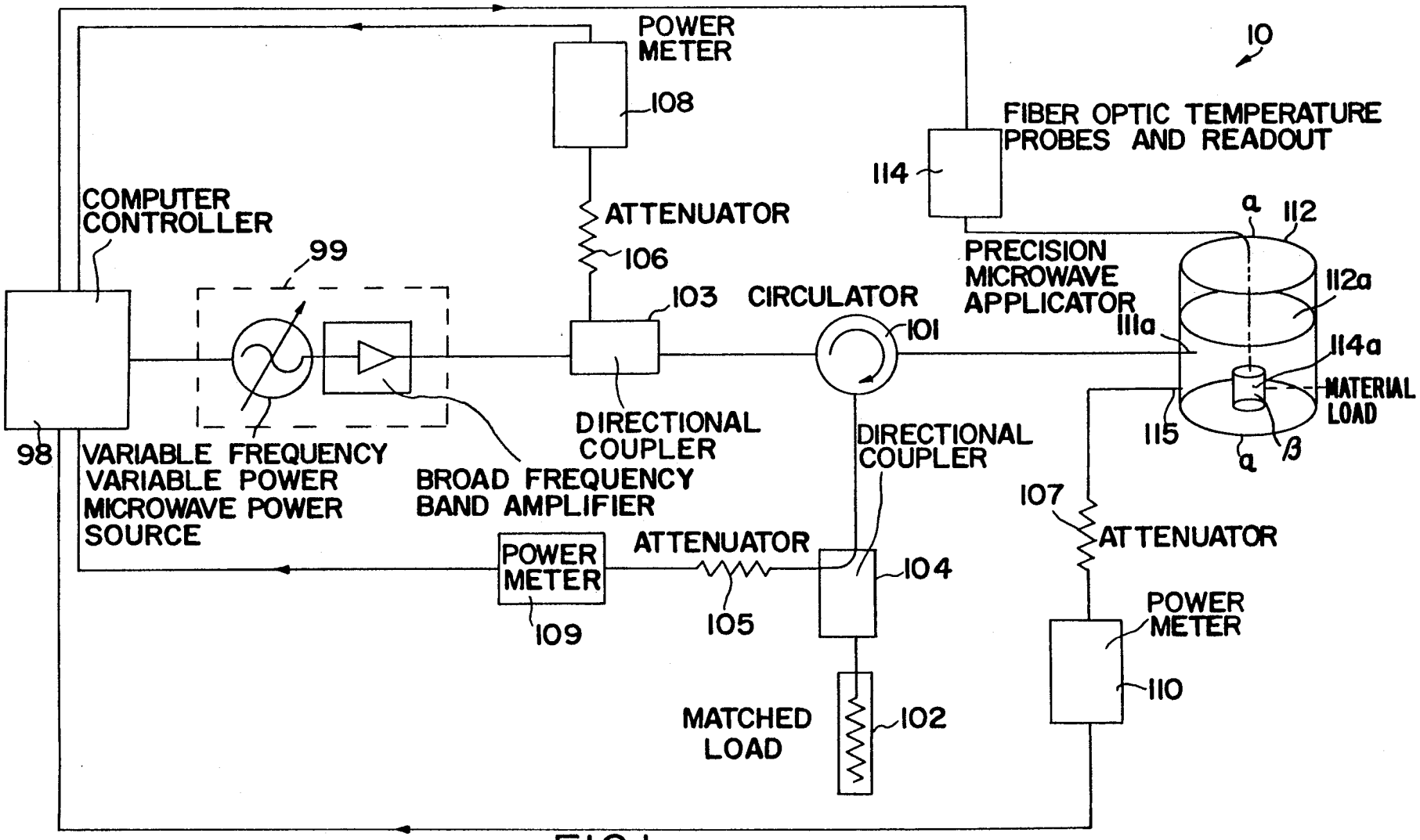

BACKGROUND OF THE INVENTION (1) Field of the Invention

The present invention relates to a method and apparatus which provides multiple, sequential radiofrequency wave processing modes for material treatment. In particular, the present invention provides a method and apparatus wherein a material is automatically processed in resonant modes which are most favorable to each stage of processing of the material.

(2) Prior Art

It is believed that the closest prior art is described in U.S. Pat. No. 4,777,336 to Asmussen, one of the present inventors. This patent describes a single mode resonant radiofrequency wave applicator (preferably microwave) used for material treatment which can be used in the present invention. This invention works well; however, single mode treatment may not be sufficient for materials which have multiple phases which are transient, such as filled uncured resins. A problem is that the prior mode in the applicator must be completely extinguished when a new mode is begun to prevent uncontrolled processing and the time sequencing of the modes must be controlled to produce the desired heating patterns. There is a need to provide multiple modes over time in the applicator in order to achieve controlled processing of materials.

OBJECTS

It is therefore an object of the present invention to provide a method and apparatus which provides controlled shifting from one mode to another without having the modes interfering which create uncontrolled processing. Further, it is an object of the present invention to provide a method and apparatus which is relatively economical to construct and which is reliable in use. These and other objects will become increasingly apparent by reference to the following description.

IN THE DRAWINGS

FIG. 1 shows a microwave apparatus 10 for coupling microwaves into an applicator 112 for treating a material B including a variable power variable frequency microwave source 99 for providing the microwaves in the applicator which is controlled by a programmable means 98, such as a computer, for rapidly changing the resonant frequency in the applicator 112 after a first mode has decayed in the applicator 112.

Figure 2:
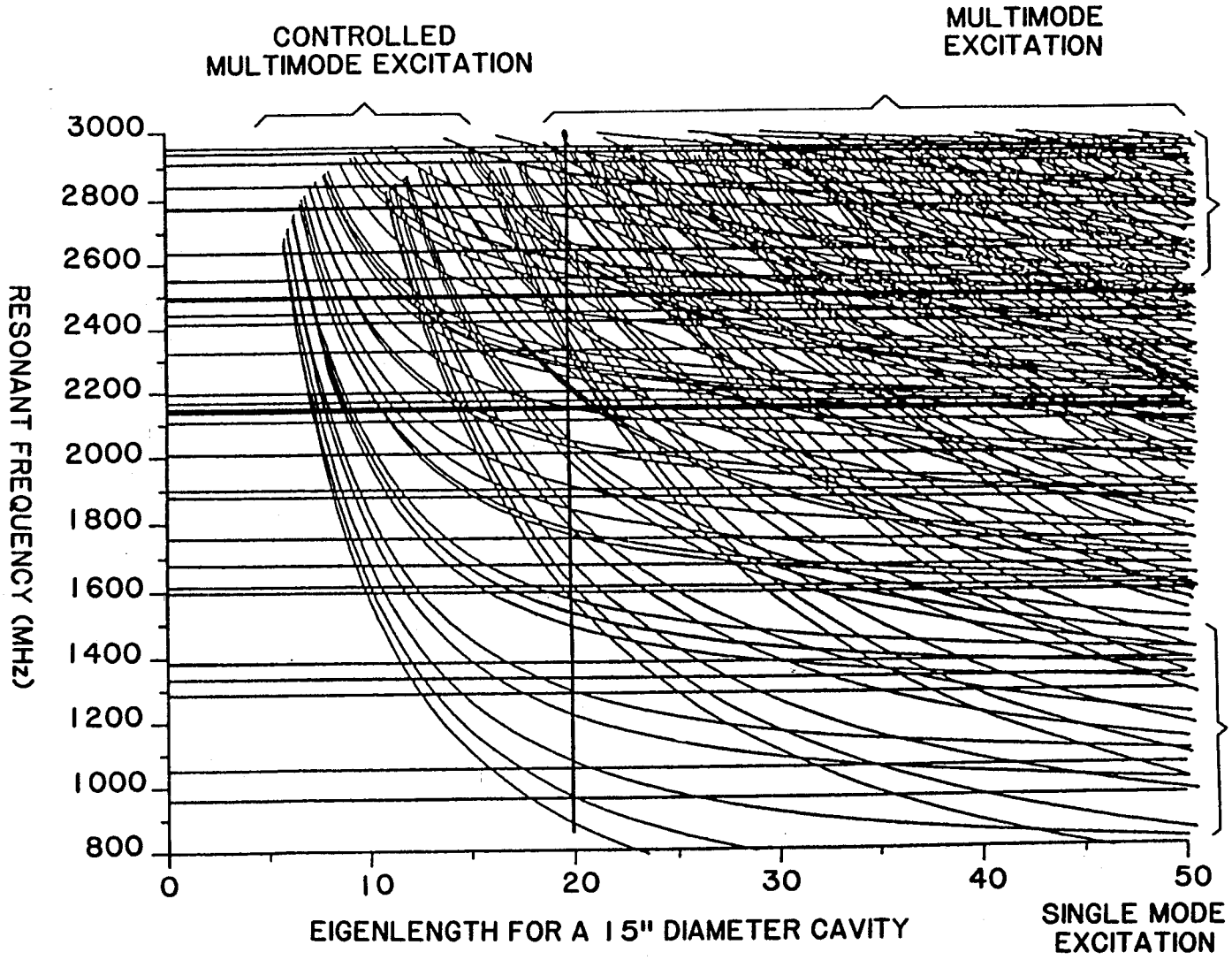

FIG. 2 is a graph showing TE and TM cavity available modes in a 15 inch (38.1 cm) diameter applicator at various frequencies. Single modes at higher frequencies can be selected and controlled multimodes (few) at lower frequencies can be selected. The multimode region (in the upper right of the FIG. 2) is avoided in the method of the present invention. The programmable means 98 shifts from one resonant mode or controlled multimode to another. The modes shown are for an empty applicator 112. A material B loaded applicator 112 has the same general patterns but exact frequency vs length curves are shifted from those shown.

Figure 3:
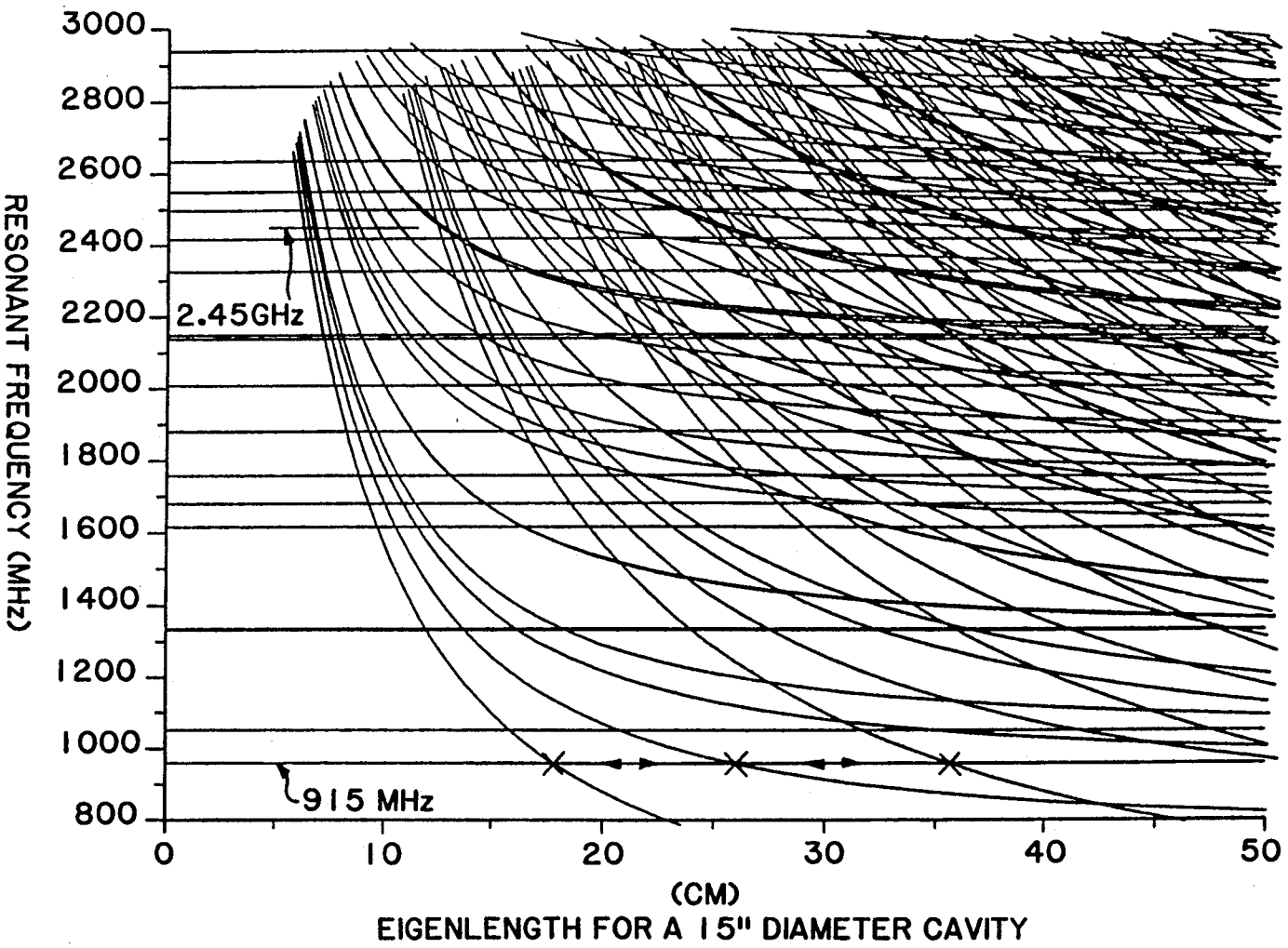

FIG. 3 shows the TE modes in a 15 inch (38.1 cm) diameter applicator 112. One or more such TE modes can be preprogrammed by the programmable means 98. This is a subset of the modes shown in FIG. 2.

Figure 4:
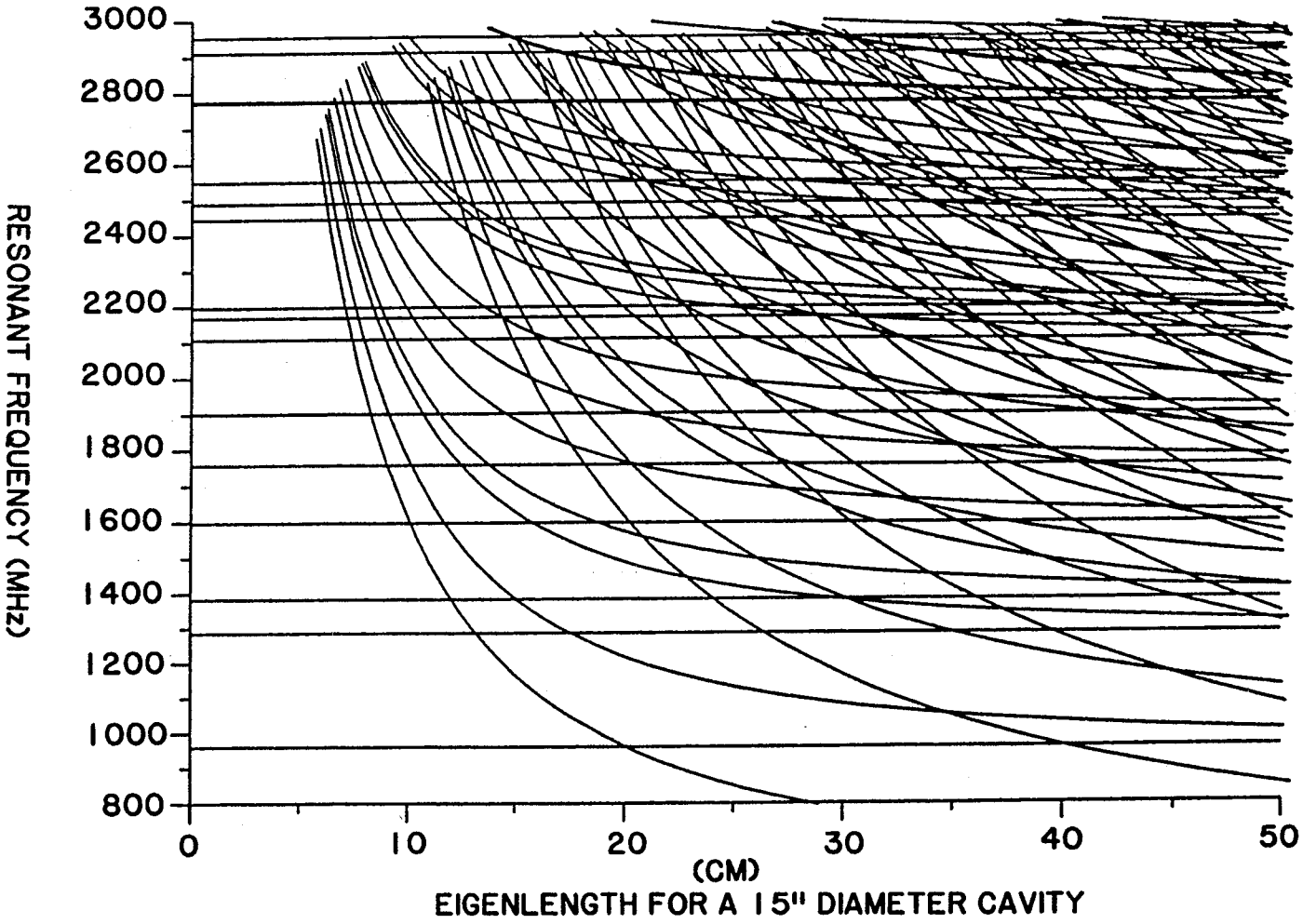

FIG. 4 shows the TM modes in the 15 inch (38.1 cm) diameter applicator 112. One or more such TM modes can be preprogrammed by the programmable means 98. This is a subset of the modes shown in FIG. 2.

Figure 5:
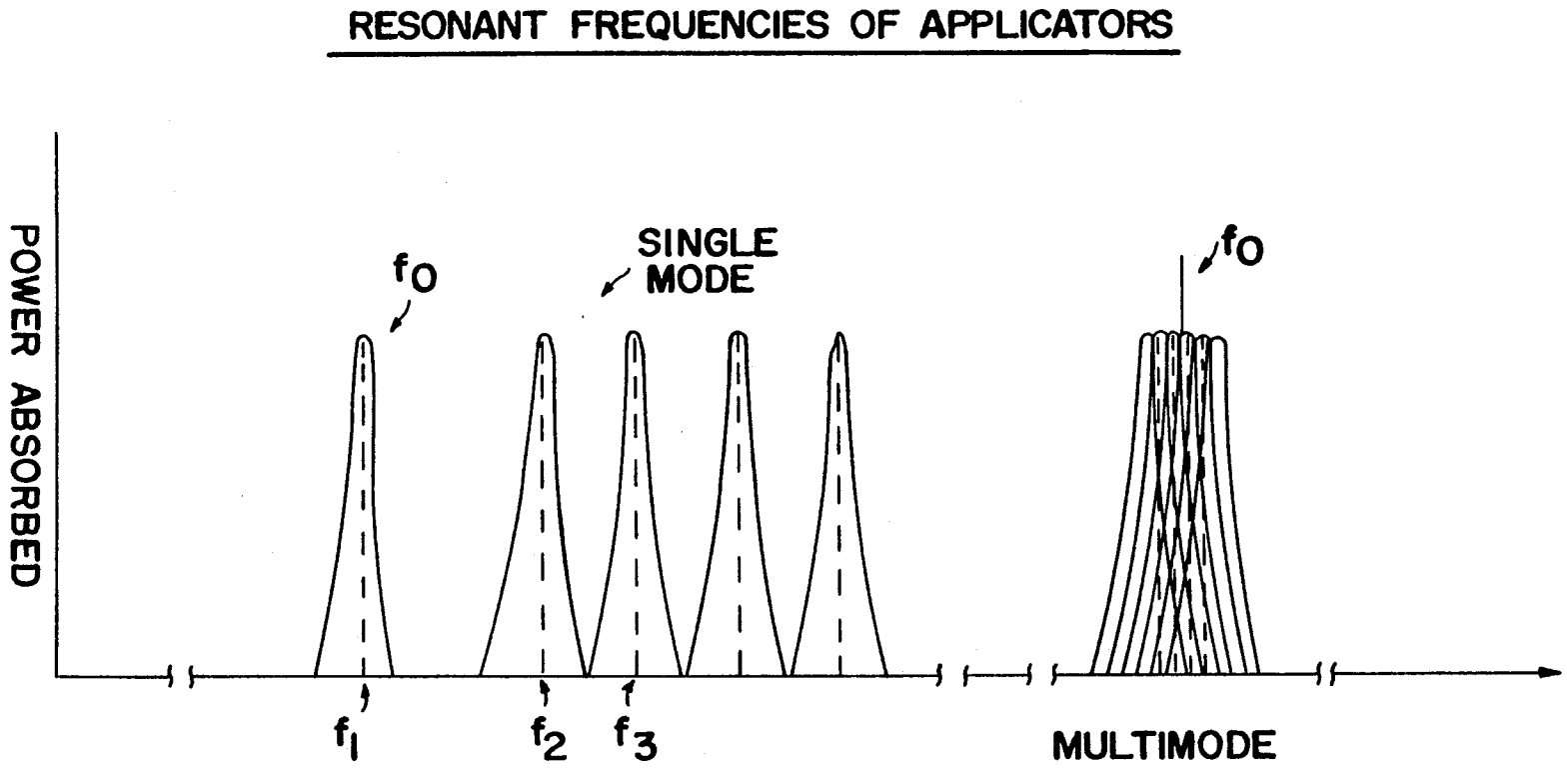

FIG. 5 shows various modes at frequencies $f_1$, $f_2$, $f_3$ etc. A controlled multimode will only have 2 or 3 overlapping resonant frequencies.

Figure 6:
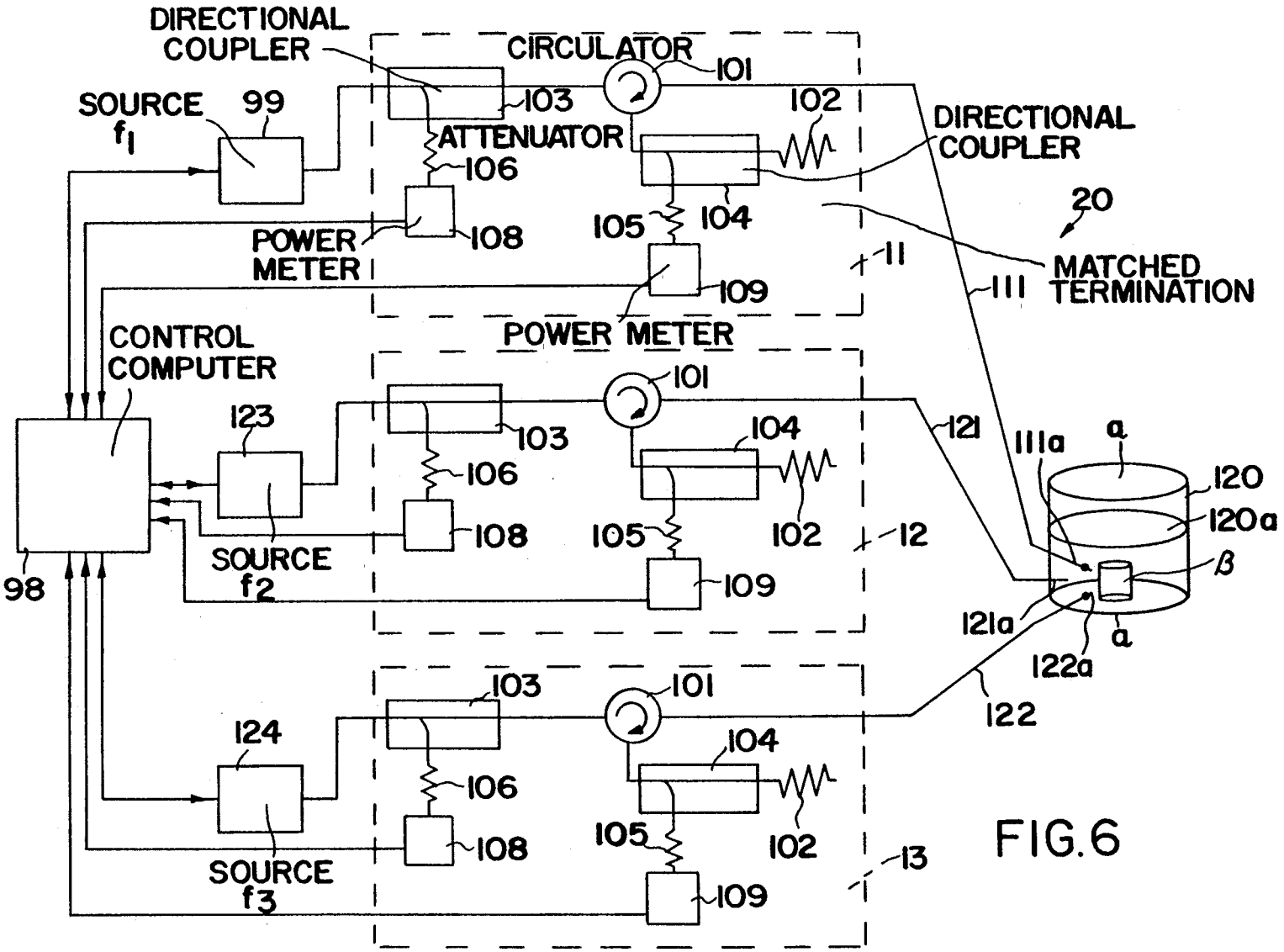

FIG. 6 shows a microwave apparatus 20 with an applicator 120 having three (3) or more separate microwave currents 11, 12 an 13 such as shown in FIG. 1 coupled to probes 111*a*, 121*a* and 122*a* and operated at different frequencies $f_1$, $f_2$ and $f_3$. The frequencies are supplied by a programmable control means 123.

GENERAL DESCRIPTION

The present invention relates to a method of heating of an initially liquid or solid material with a complex dielectric constant which changes as a function of radiofrequency heating over a heating time which comprises: providing a radiofrequency wave generating apparatus including a metallic radiofrequency wave applicator which is excited in one or more of its pre-selected material loaded modes of resonance as a single mode or controlled multimode in the applicator around an axis of the applicator so that there is pre-selected heating of the material in the applicator, antenna means connected to and extending inside the applicator for coupling the radiofrequency wave to the applicator; and continuously heating the liquid or solid material with an initial complex dielectric constant positioned in the applicator in a precisely oriented position with the radiofrequency wave and maintaining an initial mode of the radiofrequency wave with the material in the applicator as the dielectric constant of the material changes for a period of time during the heating and then shifting to at least one second mode in the applicator during the heating after the first mode is extinguished and maintaining the second mode as the complex dielectric constant of the material changes during the heating, wherein the modes in the applicator are maintained using measured incident and reflected power such that the reflected power from the applicator is continuously tuned to approximately zero in the applicator and the incident power is tuned to a desired level in the applicator.

Further the present invention relates to a method of heating of an initially liquid or solid material with a complex dielectric constant which changes as a function of radiofrequency heating over a heating time which comprises: providing a radiofrequency wave generating apparatus including a metallic radiofrequency wave applicator which is excited in one or more of its pre-selected material loaded modes of resonance as a single mode or controlled multimode in the applicator around an axis of the cavity so that there is pre-selected heating of the liquid or solid material in the applicator including moveable plate means in the applicator mounted perpendicular to the axis in the cavity with electrical contacts around an outside edge of the plate which contact inside walls of the applicator, and moveable probe means connected to and extending inside the applicator for coupling the radiofrequency wave to the applicator; continuously heating the liquid or solid material with an initial complex dielectric constant positioned in the applicator in a precisely oriented position in the applicator with the radiofrequency wave and maintaining an initial mode of the radiofrequency wave with the material in the applicator during the heating as a result of tuning by moving the antenna or the plate or by varying the frequency and power of a source of the radiofrequency wave as the dielectric constant of the material changes for a period of time during the heating and then shifting to at least one second mode in the cavity during the heating after the first mode is extinguished and maintaining the second mode as the complex dielectric constant of the material changes during the heating wherein the modes in the applicator are maintained using measured incident and reflected power such that the reflected power from the applicator is continuously tuned to approximately zero in the applicator, wherein an optimum pattern of the tuning and the power variation is used during the heating of the liquid or solid material as a function of time in the applicator.

Finally, the present invention relates to an apparatus for heating of an initially liquid or solid material with a complex dielectric constant which changes as a function of radiofrequency heating over a heating time which comprises: a radiofrequency wave generating apparatus including a metallic radiofrequency wave applicator which can be excited in one or more preselected modes of resonance as a single mode or a controlled multimode around an axis of the applicator so that there is preselected heating of the material in the applicator; and programmable means for shifting from a first mode to at least the second mode after the first mode is extinguished in the applicator. I.

The present invention is an improvement upon U.S. Pat. No. 4,777,336 by J. Asmussen. The purpose of the patented invention is to permit the faster and more spatially controlled (usually uniform processing is desired) microwave processing of solid or liquid materials which are located in a cavity or waveguide. In the above referenced patent use is made of single mode (or controlled multimode) excitation of a material loaded cavity (or waveguides). The cavity applicator is excited in one or more (slightly overlapping modes) of its material loaded modes of resonance in order to heat and process the material. Electromagnetic mode selection is made by exciting the cavity with a fixed frequency and then tuning the cavity to a given material loaded resonant length. An alternate method of excitation is to excite a fixed size cavity with a variable frequency microwave power source. In this method, the power source is frequency tuned to the desired electromagnetic resonant mode of the material loaded cavity.

When the material loaded cavity is excited, and the material is heated, the complex dielectric constant of the material changes resulting in the need to continuously retune (by length and probe, also referred to as an antenna, tuning or by probe and frequency tuning) the material loaded cavity to resonance. The mechanical tuning, power variation and frequency tuning can be utilized in order to control the process cycle or in order to achieve the desired process cycle (heating pattern with respect to time and space). It should be noted that the "tuning" discussed here carries out two distinct functions. They are (1) to initially tune the applicator to a desired material loaded cavity resonance and then (2) to tune the cavity to a match (i.e. zero reflected power) during the process cycle. The pattern of tuning and input power control is noted and then repeated to process other similar materials.

The initial material loaded mode is chosen in order to produce the desired results (i.e. desired heating pattern within the material). Thus, a particular excited mode is chosen because it provides the best field pattern in which to start the process cycle. Usually a mode is chosen so that excellent, initial, controlled microwave coupling into the material load is achieved. The material's size, shape, location within the cavity and its initial dielectric properties, denoted by initial dielectric constant $$\epsilon_r = \epsilon_r' - j\epsilon_r'',$$

all determine the initial mode resonant frequency and its initial excitation field pattern. The applicator field pattern exists within the material in the cavity of the applicator as well as the "empty" nonmaterial volumes within the cavity.

When the mode is excited, the material is heated according to classical electromagnetics. The time average absorbed power density $<P>$ at any position r within the material is given by $$<P>(r) = \tfrac{1}{2}\omega\epsilon_0\epsilon_r''(r)\,|E_0(r)|^2$$

wherein $\omega$ is the excitation frequency and $E_0$ (r) is the magnitude of the electric field at any point r within the material. Thus, the spatial power absorbed pattern (and hence the spatial heating pattern) depends on the mode spatial field pattern.

As material heating takes place, the mode spatial field pattern, $$\epsilon_r'(r) \text{ and } \epsilon_r''(r),$$

and even the material shape changes. The tuning process described above often compensates for some or all of these variations. However, there are applications where the heating may start with a desirable mode, but continuous tuning to the same resonance may produce non-optimum excitation conditions for process completion. There are also applications where the heating pattern of the initial mode is very nonuniform which results in nonuniform heating and produces hot and cold spots in the material. In both cases it may be desirable to use two or more modes during the process cycle to more uniformly and quickly heat the material load.

Thus, the present invention provides switching during processing between one mode (or set of modes) to another (or more modes) during processing. This can be performed in a number of different ways. One method is to excite the applicator with a fixed frequency microwave source and to mechanically tune the applicator (by sliding short tuning) from one resonant mode to another during processing. Another method is to switch the microwave oscillator frequency during processing from one resonant mode to another. The preselected frequency switching vs time results in a selected pattern of mode excitation vs time resulting in the desired pattern of heating within the material load and can, in fact, be used to investigate different process cycles. An advantage of this latter method, while being more complex electronically, is to utilize the process control system's ability to vary and control frequency to also match the applicator during each individual mode excitation. Thus, the sliding short on the applicator may no longer be necessary. Two of these processing configurations are shown in FIGS. 1 and 6 which can be used with or without the sliding short.

SPECIFIC DESCRIPTION

The experimental heating and processing measurements were performed with a variable power, CW, microwave system 10 (FIG. 1) or system 20 (FIG. 6).

The circuits 11, 12 and 13 consist of a (1) variable power, variable frequency oscillator and amplifier 99, (2) circulator 101 and matched dummy load 102, (3) coaxial directional couplers 103 and 104, attenuators 105, 106 and power meters 108 and 109 that measure incident power $P_i$ and reflected power $P_r$ (4), a coaxial input coupling system 111 with probe or antenna 111*a* and (5) the microwave applicator 112 and material load B. The microwave power coupled into the applicator 112 is then given by $P_t = P_i - P_r$.

Also shown in FIGS. 1 and 6 are a coaxial E field probe 115 which is inserted into the applicator 112 or 120 and is connected through an attenuator 107 to a power meter 110. This probe 115 measures the square of the normal component of electric field on the conducting surface of the applicator 112 or 120. A fiber optic temperature measuring probe 114*a* from instrument 114 was inserted into applicator 112 or 120 and is mounted on or in the material B for process temperature measurement. The E field probe 115, fiber optic temperature measurement probe 14*a*, incident and reflected power meters 108 and 110, all provide online process measurement and as such can be used as feedback signals to provide information to the programmable means 98 on when and where to switch modes.

FIG. 6 shows a multiport cavity applicator 120 with several independent input microwave circuits 10, 11 and 12 and probes or antennae 111*a*, 121*a* and 122*a*. The cavity 120 length can be varied by sliding short 120*a*. The probes 111*a*, 121*a* and 122*a* are placed to minimize the interaction (cross-coupling) between the circuits 10, 11 and 12. Optimally the circuits 10, 11 and 12 are spaced so that the near fields of the antenna 111*a*, 121*a* and 122*a* do not interact. Each probe 111*a*, 121*a* and 122*a* is connected to a separate microwave power source (oscillator) 99, 123 and 124 capable of producing power at $f_1$, $f_2$ and $f_3$. The sources 99, 123 and 124 may be of fixed or variable frequency $f_1$, $f_2$ and $f_3$, generally $f_1 \neq f_2 \neq f_3$. Each microwave circuit can be switched out of the cavity, mechanically or by diodes, when not in use.

The frequencies $f_1$, $f_2$ and $f_3$ can be adjusted to an individual (or different) applicator 112 or 120 loaded resonance(s) and thus each individual circuit 11, 12 and 13, together with the variable length short 112*a* or 120*a* and adjustable probe 111*a*, 121*a* or 122*a* can be operated at the resonance described in U.S. Pat. No. 4,777,336. Each power source 99, 124, 125 can be programmed by programmable means 98 or 123 to switch from one mode, i.e., from one resonant mode, to another, or from one polarization to another as a function of time in a manner that produces the desired heating pattern within the material (cavity) load B.

Programmable means 98 or 123 such as a computer or microprocessor are used to select the initial frequency of the resonant mode in applicator 112 or 120. The length of the applicator 112 or 120 can be varied by sliding short 112*a* or 120*a* which can also be computer controlled. In this manner the material B is subjected to different resonant modes one after the other until the material is processed.

An important feature of the applicators 112 and 120, which are preferably cylindrical, is their ability to focus and match the incident microwave energy into the process material B. This is accomplished with single mode excitation and "internal cavity" matching. By proper choice and excitation of a single electromagnetic mode in the applicator 112 or 120, microwave energy can be controlled and focused into the process material B. The matching is labeled "internal cavity" since all tuning adjustments take place inside the applicator 112 or 120. This method of electromagnetic energy coupling and matching in an applicator is similar to that employed in microwave ion sources (J. Asmussen and J. Root, Appl. Phys. Letters 44, 396 (1984); J. Asmussen and J. Root, U.S. Pat. No. 4,507,588, Mar. 26 (1985); J. Asmussen and D. Reinhard, U.S. Pat. No. 4,585,668, Apr. 29 (1986); J. Root and J. Asmussen, Rev. of Sci. Instrum. 56, 1511 (1985); M. Dahimene and J. Asmussen, J. Vac. Sci. Technol. B4, 126 (1986).

The input impedance of a microwave cavity 112 or 120 is given by $$Z_{in} = \frac{P_t + j2(W_m - W_e)}{\frac{1}{2}|I_o|^2} = R_{in} + jX_{in}$$

where $P_t$ is the total power coupled into the applicator 112 or 120 (which includes losses in the metal walls of the applicator 112 or 120 as well as the power delivered to the material B). $W_m$ and $W_e$ are, respectively, the time-averaged magnetic and electric energy stored in the applicator 112 or 120 fields and $/I_o/$ is the total input current on the coupling probe 111*a*, 121*a* or 122*a*. $R_{in}$ and $jX_{in}$ are the applicator 112 or 120 input resistance and reactance and represent the complex load impedance as seen by the feed transmission line 111 which is the input coupling system.

At least two independent adjustments are required to match the material B load to transmission line 111. One adjustment must cancel the load reactance while the other must adjust the load resistance to be equal to the characteristic impedance of the feed transmission system. In the cavity applicator 112 or 120, the continuously variable probe 111*a*, 121*a* or 122*a* and cavity end plate 112*a* or 120*a* tuning provide these two required variations, and together with single mode excitation are able to cancel the material B, loaded cavity reactance and adjust the material loaded cavity 112 or 120 input resistance to be equal to the characteristic impedance of the feed transmission line 111, 121 or 122 which is the input coupling system.

As shown in FIG. 1, the amplifier 99 is preprogrammed by a programmer 98 to switch back and forth between two or more narrow frequency bands $\Delta f_1$, $\Delta f_2$, $\Delta f_3$. Each individual frequency band has a different center frequency and excites different resonant modes in the applicator 112 and hence produces a different heating pattern within the material load B. When a specific mode is excited, frequency, sliding short 112*a*, coupling tuning and power control can be used to match the applicator 112 to control the heating process. The switching between modes can be performed at a rate depending on the process. For example, certain applications may require heating with each individual mode for only fractions of a second, i.e., a short microwave pulse of energy. Thus, the system then would quickly switch from one frequency $f_1$ to another $f_2$ etc. rapidly "bathing" the material load B with many different heating patterns. Thus, in only a fraction of a second to a few seconds the material load B then is heated uniformly. Mode switching can also occur more slowly where each mode is individually excited from a few seconds to many minutes and processing takes place over tens of minutes to over one hour.

In some processes mode switching may not only be required for uniform application of electromagnetic energy to the load, but may be also required because during heating the changes in the material complex dielectric constant $\epsilon$ have dramatically changed the mode fields into an undesirable field pattern. Proper heating is not possible with one mode alone. Then the processing system frequency must be switched (or the cavity length is varied) to excite another mode which has the correct heating pattern required to properly complete the process cycle. As indicated above, the mode switching can be accomplished with the mechanical motion of the sliding short 112*a*. In this case, the excitation frequency can be held constant and the sliding short 112*a* is moved in a predetermined manner to tune the system from one mode to another. This method of mode switching is performed mechanically and is usually slow compared to the electronic switching of the oscillation frequency by programmer 98 but has the advantage of using a low cost fixed frequency (roughly 2.45 GHz or 915 MHz) excitation source.

Even a relatively "large" diameter applicator 112 can be utilized to operate in either a single mode or controlled multimode fashion. The empty applicator 112 mode charts are developed for a 15-inch diameter cavity (FIGS. 2 to 4). FIGS. 2 to 4 are computed for the empty applicator 112. The placement of a material load B within the applicator 112 causes the empty applicator 112 modes to frequency shift; however, the general features of these resonant mode plots remain the same. Thus, FIGS. 2 to 4 serve as generic material load B loaded as well as empty applicator 112 resonant mode plots vs applicator 112 length.

FIGS. 2 to 4 display the individual resonant frequencies vs resonant length for the cylindrical 15 inch diameter applicator 112. As shown in FIG. 2, an individual mode resonant frequency varies as the axial length a-a of the applicator 112 is changed from a few centimeters to 50 cm. Each solid line in FIGS. 2 to 4 displays the variation of one individual mode resonant frequency as the applicator 112 length is increased. The lower left-hand region has been designated as the single mode region because for a given cavity length and excitation frequency only single modes (sometime degenerate modes) are excited. The upper right-hand corner is designated as the multimode region because of the high density of overlapping modes even for a fixed excitation frequency and cavity length. This multimode region is where conventional microwave heating cavities are operated. For a fixed cavity size a narrow excitation frequency band will excite many overlapping resonant modes in the multimode region. Each of these modes will excite and heat the material load.

A variable frequency oscillator 99 exciting a constant length applicator 112 can couple to many modes. This is shown in FIG. 2 as the vertical line intersecting the many resonant mode lines. The associated power absorption spectrum vs. frequency is shown in FIG. 5. Note that as frequency is increased from less than 800 MHz to over 3 GHz, the number of power absorption bands vs frequency increases from singly excited modes to multimode absorptions. It becomes clear from FIG. 2 that at the lower frequency the oscillator 99 frequency must align itself with the absorption band of a single mode in order to couple power into the applicator 112. At the higher frequencies the oscillator 99 excitation frequency will couple energy into many separate resonant modes. The electric and magnetic fields within the applicator 112 then are a superposition of the individual mode field patterns.

Single mode excitation of a variable length applicator 112 can be clearly understood from FIGS. 2 to 4. For example, exciting the applicator 112 at 915 MHz (denoted by a horizontal line in FIG. 3) results in the single excitation of a number of modes as the cavity length increases. These modes are shown as the X intersection in FIG. 2. A similar behavior with the same 15 inch applicator 112 occurs at 2.45 GHz except the number of intersections vs length is greatly increased.

As indicated earlier, the electromagnetic field pattern inside the cylindrical applicator 112 is dependent upon many factors and exact solutions for material load B loaded cavities are not available. However, the field patterns for an empty (free space) applicator 112 are well known and can serve to develop general understanding of the cavity fields. An infinite set of resonant frequencies is possible. Each resonance is produced by a waveguide mode and is an integral multiple of guided mode half wavelengths (i.e., $$\frac{n\lambda g}{2}$$

where $n=1,2, \ldots$ and where $\lambda g$ is the guided wavelength) in the axial direction. Examples of the field patterns for the lowest circular waveguide modes is shown in various standard texts such as Introduction to Microwave Theory, H. A. Atwater, McGraw-Hill Book Company (1962) and Time-Harmonic Electromagnetic Fields, R. F. Harrington, McGraw-Hill Book Company (1961), and are well known to those skilled in the art. The modes are divided into two groups, i.e. TE and TM modes.

Each mode has a distinctly individual field pattern and has regions of high and low electric field strength. By combining several of these modes, one can adjust the field strength at a given position inside the applicator and material B. Thus, by switching (vs time) from one mode to another or by exciting two or more modes simultaneously one can control the time average electric field strength at a particular position. This idea of mode superposition is used in the present invention to produce uniform heating patterns for a material load located inside of a cavity.

The concept of mode switching is also illustrated in FIG. 3. For example, if the microwave system is excited with a constant 915 MHz frequency the cavity excitation can be varied by mechanically length tuning the applicator 112 back and forth between several modes using the sliding short 112*a*. Examples of this mode switching are shown by the arrows between several of the 915 MHz mode intersection.

If the system has a applicator 112 fixed length, the same sequence of mode excitation can be accomplished by increasing the frequency from 915 MHz to a frequency that produces the appropriate mode intersection.

A careful study of the mode charts of FIGS. 3 and 4 show that there are regions where the mode switching can readily be achieved. One such region is shown as the horizontal 2.45 GHz frequency line. As shown, a very small change in cavity length or frequency will allow rapid switching between the same three cavity modes that were excited at 915 MHz. Thus, mechanical switching by sliding short 112*a* between the modes may be more readily achieved in a large cavity at 2.45 GHz. A careful adjustment of applicator 112 dimensions (in the cylindrical applicator 112 case the adjustment of length) can result in a simple (small length changes or small frequency changes) solution for the mode switching.

FIG. 5 shows that for a fixed size rectangular cavity, the mode density increases according to the formula:

$f_0$, $f_0'$ — excitation frequency $$(f_r)mnp = \frac{1}{2\sqrt{\mu\epsilon}} \sqrt{\left(\frac{m}{a}\right)^2 + \left(\frac{n}{b}\right)^2 + \left(\frac{p}{c}\right)^2} \xrightarrow[\text{cube}]{} \frac{1}{2\sqrt{\mu\epsilon}} \left(\frac{1}{a}\right) \sqrt{(m)^2 + (n)^2 + (p)^2} =$$

m=1, 2, 3, . . .
n=1, 2, 3, . . .
p=0, 1, 2, . . .

This is shown by FIGS. 2 to 4. The formula has a similar nature for a cylindrical cavity.

It is intended that the foregoing description be only illustrative of the present invention and that the present invention be limited only by the hereinafter appended claims.

We claim:

1. A method of heating of an initially liquid or solid material with a complex dielectric constant which changes as a function of radiofrequency heating over a heating time which comprises:

(a) providing a radiofrequency wave generating apparatus including a metallic radiofrequency wave applicator which is excited in one or more of its pre-selected material loaded modes of resonance as a single mode or controlled multimode in the applicator around an axis of the applicator so that there is pre-selected heating of the material in the applicator, antenna means connected to and extending inside the applicator for coupling the radiofrequency wave to the applicator; and (b) continuously heating the liquid or solid material with an initial complex dielectric constant positioned in the applicator in a precisely oriented position with the radiofrequency wave and maintaining an initial mode of the radiofrequency wave with the material in the applicator as the dielectric constant of the material changes for a period of time during the heating and then shifting to at least one second mode in the applicator during the heating after the first mode is extinguished and maintaining the second mode as the complex dielectric constant of the material changes during the heating, wherein the modes in the applicator are maintained using measured incident and reflected power such that the reflected power from the applicator is continuously tuned to approximately zero in the applicator and the incident power is tuned to a desired level in the applicator.

2. The method of claim 1 wherein the applicator has a circular cross-section.

3. The method of claim 1 wherein a switching means is used to change the modes of the radiofrequency wave in the applicator between the initial at least one and second mode during the heating.

4. The method of claim 3 wherein the switching means is a frequency switching means for changing the modes.

5. The method of claim 3 wherein the switching means is moveable plate with electrical contacts around an outside edge which contact the applicator which is moved in the applicator to change the modes.

6. The method of claim 3 wherein a programmable means is used to control the switching means to provide the modes and to maintain the modes created.

7. The method of claim 1 wherein the programmable means is a microprocessor.

8. A method of heating of an initially liquid or solid material with a complex dielectric constant which changes as a function of radiofrequency heating over a heating time which comprises:

(a) providing a radiofrequency wave generating apparatus including a metallic radiofrequency wave applicator which is excited in one or more of its pre-selected material loaded modes of resonance as a single mode or controlled multimode in the applicator around an axis of the cavity so that there is pre-selected heating of the liquid or solid material in the applicator including moveable plate means in the applicator mounted perpendicular to the axis in the cavity with electrical contacts around an outside edge of the plate which contact inside walls of the applicator, and moveable probe means connected to and extending inside the applicator for coupling the radiofrequency wave to the applicator;

(b) continuously heating the liquid or solid material with an initial complex dielectric constant positioned in the applicator in a precisely oriented position in the applicator with the radiofrequency wave and maintaining an initial mode of the radiofrequency wave with the material in the applicator during the heating as a result of tuning by moving the antenna or the plate or by varying the frequency and power of a source of the radiofrequency wave as the dielectric constant of the material changes for a period of time during the heating and then shifting to at least one second mode in the cavity during the heating after the first mode is extinguished and maintaining the second mode as the complex dielectric constant of the material changes during the heating wherein the modes in the applicator are maintained using measured incident and reflected power such that the reflected power from the applicator is continuously tuned to approximately zero in the applicator, wherein an optimum pattern of the tuning and the power variation is used during the heating of the liquid or solid material as a function of time in the applicator.

9. The method of claim 8 wherein a time lapse is provided to allow the first mode to be extinguished before the second mode begins.

10. The method of claim 8 wherein the material is positioned adjacent to a bottom portion of the applicator opposite the moveable plate and on the axis of the applicator.

11. The method of claim 8 wherein the material is solid, wherein a portion of the material is volatilized during the heating and wherein the applicator is vented.

12. The method of claim 8 wherein a bottom portion of the applicator is removable so that the material can be positioned in the applicator by removing the bottom portion.

13. The method of claim 8 wherein the applicator is provided with an access opening for inserting a detector to determine electric or magnetic field strengths inside the applicator as a function of time.

14. The method of claim 8 wherein a switching means is used to change the modes of the radiofrequency wave between the initial and second modes during the heating.

15. The method of claim 8 wherein the switching means is a frequency switching means for changing the modes.

16. The method of claim 8 wherein the switching means is a moveable plate with electrical contacts around an outside edge which contact the applicator which is moved in the applicator to change the modes.

17. The method of claim 8 wherein a programmable means is used to control the switching means to provide the modes and to maintain the modes created.

18. The method of claim 17 wherein the programmable means is a microprocessor.

19. An apparatus for heating of an initially liquid or solid material with a complex dielectric constant which changes as a function of radiofrequency heating over a heating time which comprises:

(a) a radiofrequency wave generating apparatus including a metallic radiofrequency wave applicator which can be excited by an antenna in one or more pre-selected modes of resonance as a single mode or a controlled multimode around an axis of the applicator so that there is pre-selected heating of the material in the applicator; and (b) programmable means connected to the antenna which shifts the radiofrequency excited by the antenna from a first mode to at least one second different mode only after the first mode is extinguished in the applicator without removing the material from the applicator, wherein each of the modes in the applicator is tuned to maintain the mode by the programmable means using measured incident and reflected power from the applicator.

20. The apparatus of claim 19 wherein the programmable means is a computer.

21. The apparatus of claim 19 wherein the programmable means is a microprocessor.

22. The apparatus of claim 19 wherein multiple probes are mounted on the cavity to couple radiofrequency waves into the cavity sequentially to provide different processing modes in sequence.

23. The apparatus of claim 22 wherein in use the radiofrequency waves are different for each of the probes.

24. A method of heating an initially liquid or solid material with a complex dielectric constant which changes as a function of radiofrequency heating over a heating time which comprises:

(a) providing a radiofrequency wave generating apparatus including a metallic radiofrequency wave applicator which can be excited by an antenna in one or more pre-selected modes of resonance as a single mode or a controlled multimode around an axis of the applicator so that there is pre-selected heating of the material in the applicator; and programmable means connected to the antenna which shifts the radiofrequency excited by the antenna from a first mode to at least one second different mode only after the first mode is extinguished in the application without removing the material from the applicator, wherein each of the modes in the applicator is tuned to maintain the mode by the programmable means using measured incident and reflected power from the applicator; and (b) heating the material with the radiofrequency waves with switching of the modes by the programmable means.

25. The method of claim 24 wherein the programmable means is a computer.

26. The method of claim 24 wherein the programmable means is a microprocessor.

27. The method of claim 24 wherein multiple probes are mounted on the cavity to couple radiofrequency waves into the cavity sequentially to provide different processing modes in sequence.

28. The method of claim 27 wherein in use the radiofrequency waves are different for each of the probes.

* * * * *

UNITED STATES PATENT AND TRADEMARK OFFICE

CERTIFICATE OF CORRECTION

PATENT NO. : 5,008,506

DATED : April 16, 1991

INVENTOR(S) : Jes Asmussen and Ronald E. Fritz

It is certified that error appears in the above—identified patent and that said Letters Patent is hereby corrected as shown below:

Column 2, line 12, "an 13" should read --and 13--.

Column 4, line 12, " $\epsilon_r = \epsilon_r' - j\epsilon_r''$. " should read -- $\hat{\varepsilon}_r = \varepsilon_r' - j\varepsilon_r''$, --.

Column 4, line 22, "position r" should read --position $\vec{r}$--.

Column 4, line 25, " $\langle P\rangle(r) = \frac{1}{2}\omega\epsilon_0\epsilon_r''(r)\,|E_0(r)|^2$ " should read -- $\langle P\rangle(\vec{r}) = 1/2\,\omega\varepsilon_0\varepsilon_r''(\vec{r})\,\left|\vec{E}_0\left(\vec{r}\right)\right|^2$ --.

Column 4, line 26, "and "$E_0(r)$" should read --$E_0(\vec{r})$--.

Column 4, line 27, "r" should read --$\vec{r}$--.

Column 4, line 35 " $\epsilon_r'(r)$ and $\epsilon_r''(r)$. " should read -- $\varepsilon_r'(\vec{r})$ and $\varepsilon_r''(\vec{r})$, --.

Column 5, line 28, "probe 14a" should read --probe 114a--.

UNITED STATES PATENT AND TRADEMARK OFFICE

CERTIFICATE OF CORRECTION

PATENT NO. : 5,008,506

DATED : April 16, 1991

INVENTOR(S) : Jes Asmussen, et al.

It is certified that error appears in the above-identified patent and that said Letters Patent is hereby corrected as shown below:

Column 7, line 11, constant $\varepsilon$" should read --constant $\hat{\varepsilon}$--.

Signed and Sealed this

Twenty-seventh Day of October, 1992

*Attest:*

DOUGLAS B. COMER

*Attesting Officer*

*Acting Commissioner of Patents and Trademarks*